US010682871B2

(12) United States Patent
Sosnowski et al.

(10) Patent No.: US 10,682,871 B2
(45) Date of Patent: Jun. 16, 2020

(54) SKEWING PRINT MEDIUM

(71) Applicant: HEWLETT-PACKARD DEVELOPMENT COMPANY, L.P., Houston, TX (US)

(72) Inventors: Luke P. Sosnowski, Vancouver, WA (US); Mark H. MacKenzie, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/570,885

(22) PCT Filed: Jul. 13, 2015

(86) PCT No.: PCT/US2015/040231
§ 371 (c)(1),
(2) Date: Oct. 31, 2017

(87) PCT Pub. No.: WO2017/010988
PCT Pub. Date: Jan. 19, 2017

(65) Prior Publication Data

US 2018/0093507 A1 Apr. 5, 2018

(51) Int. Cl.
*B41J 29/38* (2006.01)
*B41J 13/26* (2006.01)
(Continued)

(52) U.S. Cl.
CPC ..... *B41J 13/26* (2013.01); *B41J 2/07* (2013.01); *B41J 11/0095* (2013.01);
(Continued)

(58) Field of Classification Search
USPC ..... 347/16, 19
See application file for complete search history.

(56) References Cited

U.S. PATENT DOCUMENTS 6,364,554 B2 4/2002 Huang et al.
7,227,667 B2 6/2007 Ikeda
(Continued)

FOREIGN PATENT DOCUMENTS

KR 20000065586 11/2000

OTHER PUBLICATIONS

Peripherals. Dell Monitors, Printers, Projectors, Hardware and Software Discussion. A940 Printer Mis-Feeds Paper.

*Primary Examiner* — Lam S Nguyen
(74) *Attorney, Agent, or Firm* — Fabian VanCott

(57) ABSTRACT

In one example implementation, a printing device may comprise a number of media skewing rollers to skew a print medium to a predetermined angle with respect to a media feed path and a print engine to print an image on the skewed print medium, the print engine skewing a digital representation of the image based on the predetermined angle such that the image printed is aligned with the print medium. In another example implementation, a printing device may comprise a number of skewing rollers to skew a print medium to a predetermined angle with respect to a media path, a number of pinch rollers to receive the skewed print medium prior to printing, and a print engine skewed to the same predetermined angle as the skewed print medium.

17 Claims, 8 Drawing Sheets

(51) Int. Cl.

| | |
|---|---|
| ***B41J 13/03*** | (2006.01) |
| ***B41J 29/393*** | (2006.01) |
| ***B41J 2/07*** | (2006.01) |
| ***B41J 11/00*** | (2006.01) |
| ***B41J 13/00*** | (2006.01) |
| ***B65H 9/00*** | (2006.01) |
| ***B65H 5/06*** | (2006.01) |
| ***B65H 7/20*** | (2006.01) |

(52) U.S. Cl.

CPC ..... *B41J 13/0027* (2013.01); *B41J 13/03* (2013.01); *B41J 29/38* (2013.01); *B41J 29/393* (2013.01); *B65H 5/062* (2013.01); *B65H 7/20* (2013.01); *B65H 9/002* (2013.01); *B65H 2404/133* (2013.01); *B65H 2511/216* (2013.01); *B65H 2511/414* (2013.01); *B65H 2701/1311* (2013.01)

(56) References Cited

U.S. PATENT DOCUMENTS

| | | | | |
|---|---|---|---|---|
| 8,290,302 | B2 | 10/2012 | Nafarieh | |
| 2003/0095722 | A1 | 5/2003 | Regimbal | |
| 2006/0012109 | A1 | 1/2006 | Chiang | |
| 2008/0006992 | A1* | 1/2008 | Inoue | B65H 9/002 271/228 |
| 2008/0180479 | A1 | 7/2008 | Rius et al. | |
| 2008/0230975 | A1 | 9/2008 | Matsuzuki et al. | |
| 2009/0244143 | A1 | 10/2009 | Huang | |
| 2011/0132957 | A1* | 6/2011 | Kawaguchi | B65H 23/038 226/27 |
| 2013/0215164 | A1* | 8/2013 | Mayumi | G03B 35/14 347/2 |

* cited by examiner

SKEWING PRINT MEDIUM

BACKGROUND

Printing devices provide a user with the ability to replicate a document or picture. During the printing process a number of rollers may cooperate to convey a sheet of print medium through a print path to a print engine where, in one example, an ink or other printing fluid is ejected onto the print medium via the print engine. In some situations, the rollers used may create visible image quality errors.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
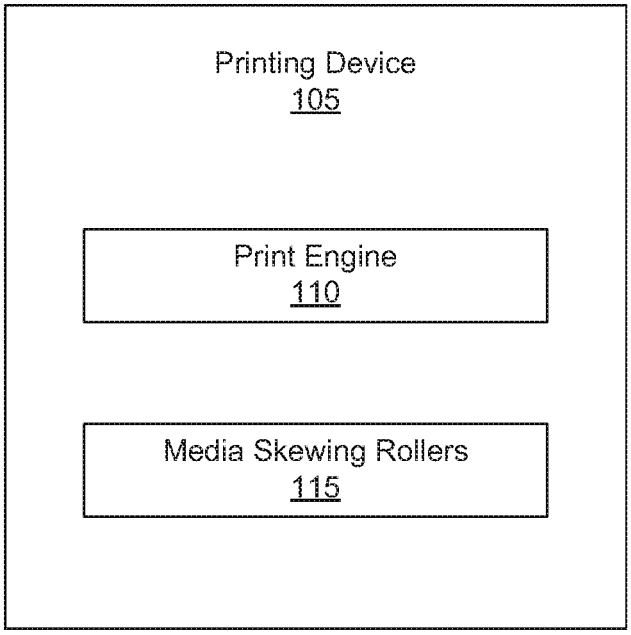
FIG. 1 is a block diagram of a printing device according to an example of the principles described herein.

As described above, some printing devices may include a number of rollers that convey the print medium through the printing device. These rollers may help in the conveyance of the print medium but may also cause image quality issues due to changes in the velocity of the print medium as it proceeds through the printing device among other causes.

By way of example, a number of pinch rollers may be used in the printing device to convey the print medium to the print engine. In a page-wide, continuous print system, for example, visible banding or the presence or absence of printed lines may occur due to variations in the velocity of the printed medium as the pinch rollers pass it under the print engine. This banding may occur regardless of the type of print engine used in the printing device. Instead, the velocity variation of the print medium causes ink dot placement errors that result in visible banding. The visible banding is objectionable to a user and creates an inferior product.

The velocity variation caused by the pinch rollers originates with the abrupt cut-sheet leading and trailing edge transitions between sheets of print medium in and out of the pinch rollers. The transitions are abrupt because the print medium edges are kept perpendicular to the pinch rollers and any impingement or release of the print medium by the pinch rollers occurs across the entire sheet a once.

Generally, a printing device registers a sheet of print medium squarely to the printhead so as to ensure that margins of the printed image are even along any edge of the print medium. These printing devices use specialized print medium registration systems to ensure that any non-square pages are straightened with respect to the pinch rollers before being presented to the pinch rollers.

In some instances, different types of pinch rollers have been used. For example, a lower pinch force has been applied to the sheet of print medium by the pinch rollers. However, lower pinch force-type pinch rollers have been proven to be unable to handle a significant number of types of media due to slippage of these types of media at the feed pinch. Alternatively, the pinch rollers could be constructed out of a softer material. Softer pinch rollers, however, use significantly softer material and also present additional issues with the media feed such as media creep and increased ink damage. Another alternative has been to form larger diameter pinch rollers. Again, however, these larger pinch rollers are undesirable due to the decrease in the sizes of printing devices. Yet another alternative has been to create a number of "popping" pinch rollers that are not completely circular or are flat on at least one side of the roller. These types of rollers present additional issues including increased acoustic noises. Even worse, proposed staggered pinch rollers could create additional distinct transition zones causing not only additional media velocity issues but also undesirable pitch angles in the media as the media is presented under the print engine.

Empirical testing has demonstrated, and the present specification describes, that if the sheets of print medium enters the pinch rollers at a slight angle such as 0.25 to 10 degrees, the visual errors produced otherwise may be minimized. This is due to the fact that the impingement of the sheet of print medium occurs over the entire length of, for example, the leading edge of the print medium.

The present specification, describes a printing device including a number of media skewing rollers to skew a print medium to a predetermined angle with respect to a media feed path and a print engine to print an image on the skewed print medium, the print engine skewing a digital representation of the image based on the predetermined angle such that the image printed is aligned with the print medium.

The present specification describes a printing device including a number of skewing rollers to skew a print medium to a predetermined angle with respect to a media path, a number of pinch rollers to receive the skewed print medium prior to printing, and a print engine skewed to the same predetermined angle as the skewed print medium.

The present specification describes a system for skewing media along a media feed path including a number of pinch rollers to receive a skewed print medium skewed at a predetermined angle with respect to a common axis of the pinch rollers and a print engine to print onto the print medium and to compensate for the skewness of the print medium.

As used in the present specification and in the appended claims, the term "print engine" is meant to be understood as a unit that does the actual printing of an image onto a print medium. In one example, the print engine may include a print controller that translates a computer or software's output commands into the signals that a print engine can use to print a page.

Additionally, as used in the present specification and in the appended claims, the term "top-of-form (TOF)" is meant to be understood as the print start position or the position the printing device starts printing from at the top of the page.

Further, as used in the present specification and in the appended claims, the term "edge registration" is meant to be understood as the alignment of an image to be printed on a sheet print medium in reference to any edge of the print medium. These edges may include a top edge, a bottom edge, the left edge, and the right edge.

Still further, as used in the present specification and in the appended claims, the term "printing device" is meant to be understood as any device that creates a graphical representation on a medium. In an example, the medium may be paper. In an example, an ink is used to form the graphical representation.

Even still further, as used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1 is a block diagram of a printing device (105) according to an example of the principles described herein. The printing device (105) may include a print engine (110) and a number of media skewing rollers (115). Each of these will now be discussed in more detail below.

The printing device (105) may be any type of printing device that receives image data and produces an image on a sheet of print medium. In one example, the printing device (105) may be communicatively coupled to a computing device and receive image data from the computing device. In another example, the printing device (105) may be communicatively coupled to other sources of image data via a network such as an intranet, an internet, or the Internet.

The printing device (105) may be utilized in any data processing scenario including, stand-alone hardware, mobile applications, through a computing network, or combinations thereof. Further, the printing device (105) may be used in a computing network, a public cloud network, a private cloud network, a hybrid cloud network, other forms of networks, or combinations thereof. In one example, the methods provided by the printing device (105) are provided as a service over a network by, for example, a third party.

To achieve its desired functionality, the printing device (105) may include various hardware components. Among these hardware components may be a number of processors including a raster image processor, a number of data storage devices, and a number of network adapters. These hardware components may be interconnected through the use of a number of busses and/or network connections. In one example, the processor, data storage device, and network adapter may be communicatively coupled via a bus.

The print engine (110) may be any type of print engine that prints an image onto a sheet of print medium by ejecting a fluid such as ink onto the print medium. In one example, the print engine (110) implements piezoelectric elements to eject the fluid out of a number of orifices defined in the print engine (110). In another example, the print engine (110) implements thermal resistive elements to eject fluid out of the number of orifices defined in the print engine (110).

The number of media skewing rollers (115) may be any type of roller that individually or in combination with any number of rollers skews a sheet of print medium. In one example, the number of media skewing rollers (115) is two with each media skewing roller (115) operating independent or independently driven. In this example, the two media skewing rollers (115) may independently rotate and cooperate together in order to skew the sheet of print medium to a specified angle relative to a media feed path within the printing device (105).

A media feed path can be any path that a sheet of print medium travels through the printing device (105) and which forms a two-dimensional plane at least immediately prior to a set of pinch rollers. The media feed path may accommodate for any size of print media. In previous printing devices, the sheet of print medium is usually aligned with respect to this media feed path. In these printing devices, the alignment is such that the sheet of print medium engages a number of pinch rollers squarely such that the entire leading edge of the sheet of print medium is captured by the pinch rollers. In the present specification, however, the sheet of print medium is skewed using the media skewing rollers (115) and as a result is skewed with reference to the media feed path.

In the example where the two media skewing rollers (115) work independently, one of the two media skewing rollers (115) may momentarily rotate relatively slower than the other to achieve a specific skewness in the sheet of print medium. In another example, one of the two media skewing rollers (115) may momentarily rotate in an opposite direction that the other to achieve a specific skewness in the sheet of print medium. In either example, a specific skewness of the sheet of print medium is maintained at least until the sheet of print medium engages with a number of pinch rollers. As will be described in more detail below, the pinch rollers engage an entire leading edge of the sheet of print medium gradually when skewed. This prevents any banding or other visual defects in a printed image from occurring.

The above examples including two media skewing rollers (115) is merely an example. The present specification, therefore, contemplates any number of media skewing rollers (115) being used to skew the sheet of print medium.

As will be described in more detail below, the printing device (105) may further include a number of other devices used to maintain a predefined skewness of the sheet of print medium as the sheet of print medium passes along the media feed path. In one example, a number of sensors may be used to detect a leading edge of the sheet of print medium. The sensors may provide continuous closed-loop feedback to, for example, a processor which in turn directs the number of media skewing rollers (115) to selectively deskew or skew the sheet of print medium relative to the media feed path to achieve a predetermined skewness or non-skewness. In one example where the print medium is to be skewed, the skewness of the sheet of print medium may be defined as an angle. The sensors may determine that the sheet of print medium is skewed to a certain degree such that the sheet of print medium is skewed by an angle $\theta$ relative to the media feed path.

In one example, the media skewing rollers (115) may selectively skew and deskew a sheet of print medium as directed by a processor associated with the printing device (105). In one example, the media skewing rollers (115) may selectively skew the sheet of print medium and maintain the skewness of the print medium. In one example, the media skewing rollers (115) may selectively deskew the sheet of print medium to correct the skewness of the sheet of print medium and deskew the print medium relative to the media feed path. In these examples, the printing device (105) may include a user selection to have the printing device (105) selectively skew the print medium and maintain the skewness of the print medium or prevent the print medium from skewing and maintain the sheet of print medium in an unskewed state relative to the media feed path.

Figure 2:
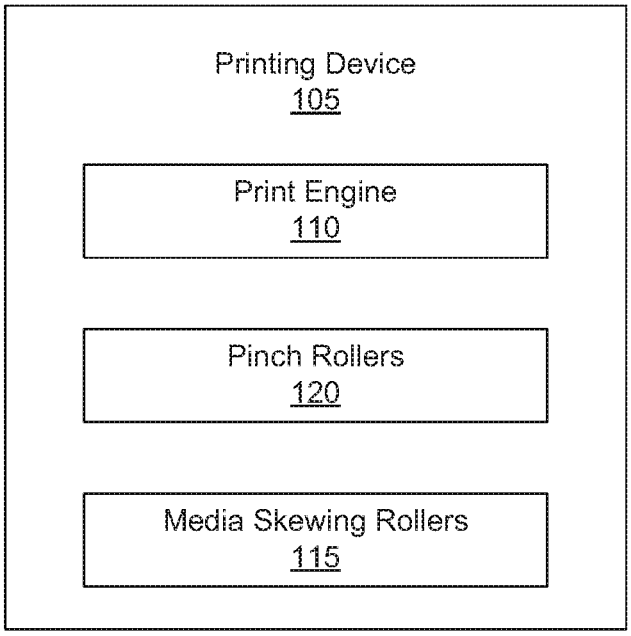
FIG. 2 is a block diagram of a printing device according to an example of the principles described herein.

The pinch rollers are described in more detail in connection with FIG. 2. FIG. 2 is a block diagram of a printing device (105) according to an example of the principles described herein. The printing device (105) of FIG. 2 may be similar to the printing device (105) of FIG. 1 and may further include a number of pinch rollers (120). As briefly described above, the number of pinch rollers (120) impinges a leading edge of the sheet of print medium. However, the number of pinch rollers (120) may receive a skewed sheet of print medium. Because the number of pinch rollers (120) are aligned and have a common axis, the number of pinch rollers (120) may gradually feed the skewed sheet of print medium therethrough such that the leading edge of the sheet of print medium is not entirely impinged when the sheet of print medium is pulled through. As described above, this prevents visual defects in the printed image such as banding from forming due to the variation in velocity of the sheet of print medium as it is passed along the media feed path.

Figure 3:
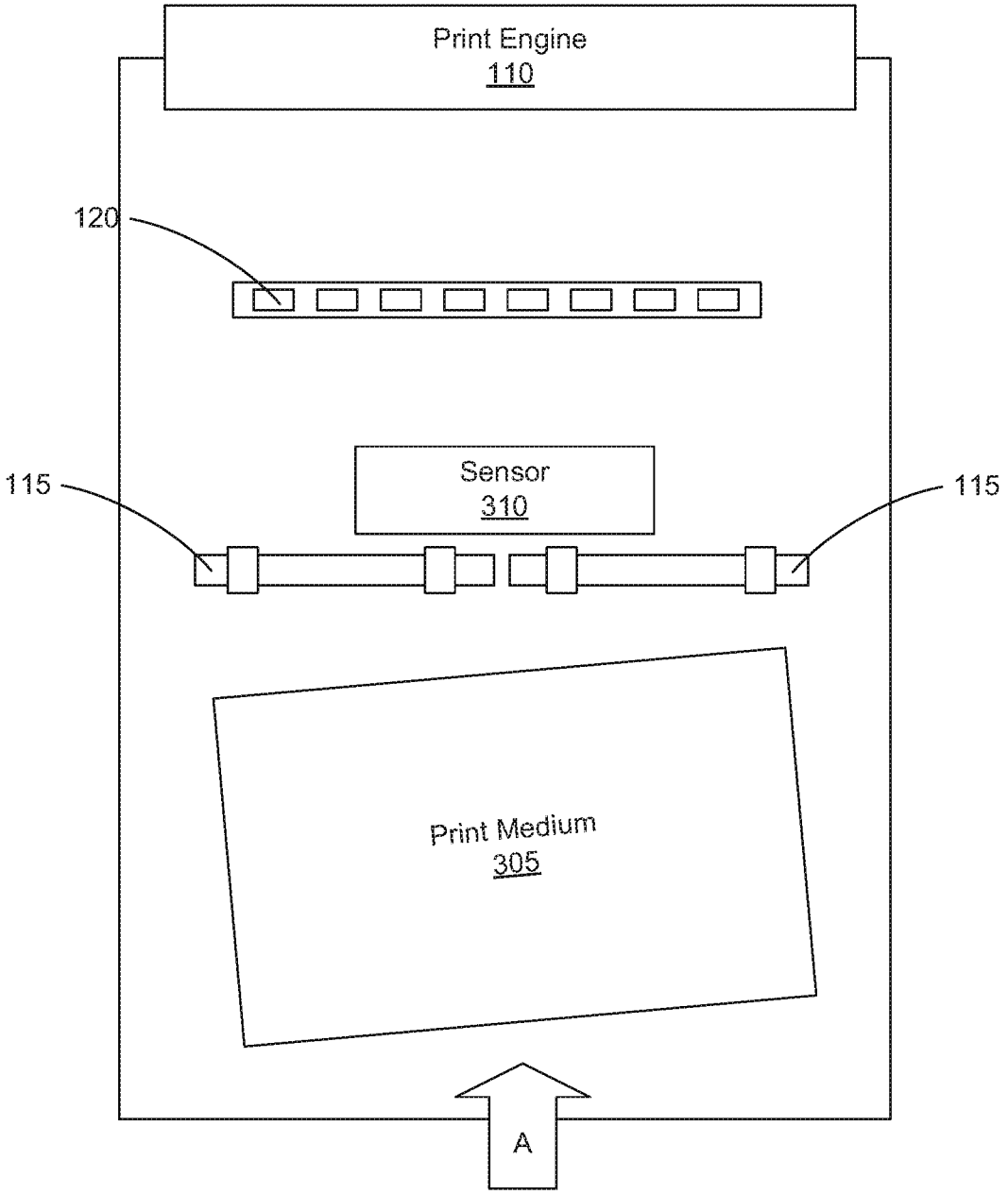
FIG. 3 is a block diagram showing a media feed path within a printing device according to an example of the principles described herein.

FIGS. 3-6 are block diagrams showing different stages among a media feed path within a printing device according to an example of the principles described herein. FIG. 3 shows a general layout of some of the physical devices used to process the sheet of print medium (305) through the printing device (105). The sheet of print medium (305) may be placed at the beginning of the media feed path situated prior to a number of media skewing rollers (115). The sheet of print medium (305) may then follow the directional flow of the media feed path as indicated by arrow "A." As the sheet of print medium (305) is first passed into the media feed path, it may initially be skewed or at least its angle of skewness relative to the media feed path is unknown. As will be described in more detail below, the skewness or lack thereof of the sheet of print medium (305) may be corrected by the media skewing rollers (115).

In one example, the printing device (105) may include a number of deskewing rollers placed prior to a number of media skewing rollers (115). The deskewing rollers may first deskew a sheet of print medium (305) prior to being skewed by the media skewing rollers (115). In this example, the deskewing rollers may align a leading edge of the sheet of print medium (305) perpendicular with respect to the media feed path. This places the leading edge of the sheet of print medium (305) parallel with an axis common among the media skewing rollers (115) and pinch rollers (120). Aligning the sheet of print medium (305) parallel with the common axis of the media skewing rollers (115) may allow the media skewing rollers (115) to better skew the sheet of print medium (305) at a predetermined angle. An skewness sensor (310) may be used to provide a processor with information regarding the skewness of the sheet of print medium (305) and cause the deskewing rollers to deskew the sheet of print medium (305) as described above.

As the print medium progresses along the media feed path, the sheet of print medium (305) may encounter a number of media skewing rollers (115). As described above, the media skewing rollers (115) skew the sheet of print medium (305) to a predetermined skewness in preparation for impingement with a number of pinch rollers (120).

A skewness sensor (310) may also be used by a processor associated with the printing device (105) to direct the media skewing rollers (115) on how to skew the sheet of print medium (305). The skewness sensor (310) may provide continuous closed-loop feedback to the processor such that the processor may continually direct the media skewing rollers (115) to maintain the sheet of print medium (305) at a predetermined skewness. This may be done while the print medium progresses along the media feed path. In one example, during operation of the printing device (105), the skewness sensor (310) may detect the skewness of the sheet of print medium (305) between the media skewing rollers (115) and the pinch rollers (120). In another example, during operation of the printing device (105), the skewness sensor (310) may detect the skewness of the sheet of print medium (305) along the entire media feed path. In this example, the skewness sensor (310) may be moved along the media feed path as sheet of print medium (305) is transported through the media feed path using a number of mechanical devices.

Figure 4:
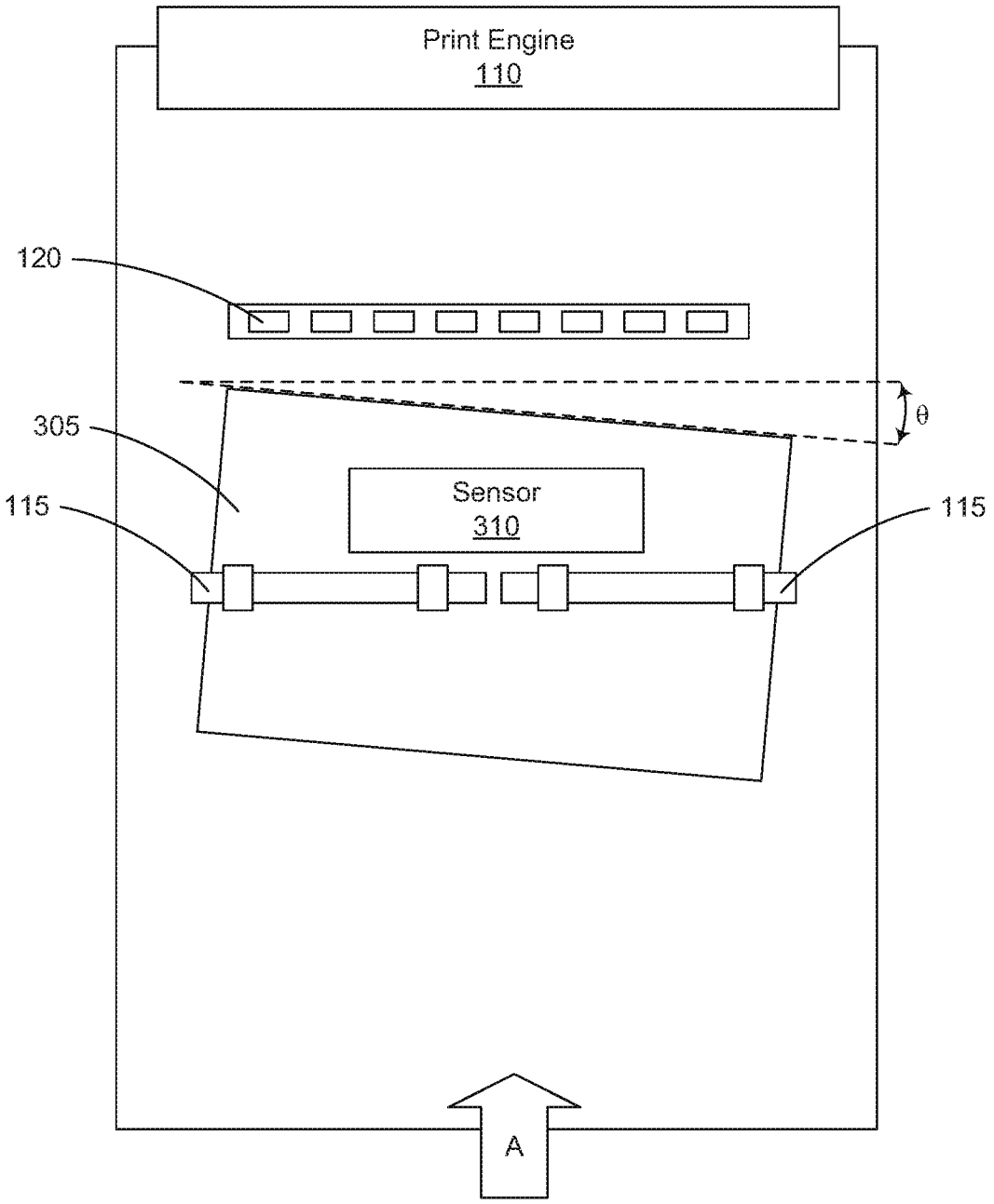
FIG. 4 is a block diagram showing a media feed path within a printing device according to an example of the principles described herein.

The predetermined skewness of the sheet of print medium (305) may be set to a specific angle with respect to the media feed path. This angle may be determined by reviewing the banding or other visual errors produced and altering the angle until a visually acceptable image is produced by the printing device (105). An optical scanner may be utilized to determine if banding is occurring and correct the angle for a subsequent print job. The angle may, however, depend on a number of factors including the size of the sheet of medium used, the type of the medium used, and/or the weight of the medium used. Still further, angle may depend on the type of printing device (105) used as well as the type of rollers, particularly the pinch rollers (120), used in the printing device (105). In one example, the angle of the leading edge of the sheet of print medium (305) may be between 1 to 3 degrees relative to the perpendicular of the media feed path or the parallel of a common axis of the pinch rollers (120). In one example, the angle of the leading edge of the sheet of print medium (305) may be between 0.25 to 10 degrees relative to the perpendicular of the media feed path or the parallel of a common axis of the pinch rollers (120). This angle is indicated in FIG. 4 as angle θ. As described above, presenting the sheet of print medium (305) at a skewed angle relative to the parallel of the common axis of the pinch rollers (120) prevents the pinch rollers (120) from erroneously changing the velocity of the sheet of print medium (305) as it is pulled through the pinch rollers. This is because any transition errors experienced by the sheet of print medium (305) are spread throughout the entire leading and trailing edges of the sheet of print medium (305).

FIG. 4 is a block diagram showing a media feed path within a printing device (105) as the sheet of print medium (305) progresses through the media skewing rollers (115). As described above, the media skewing rollers (115), via input to a processor from the skewness sensor (310), skews the sheet of print medium (305) to a predetermined angle θ before presenting the sheet of print medium (305) to the pinch rollers. The angle θ is maintained at least until the sheet of print medium (305) engages with the pinch rollers (120). In one example the pinch rollers (120) maintain the angle θ of the sheet of print medium (305) as the sheet of print medium (305) is being printed on by the print engine (110).

Figure 5:
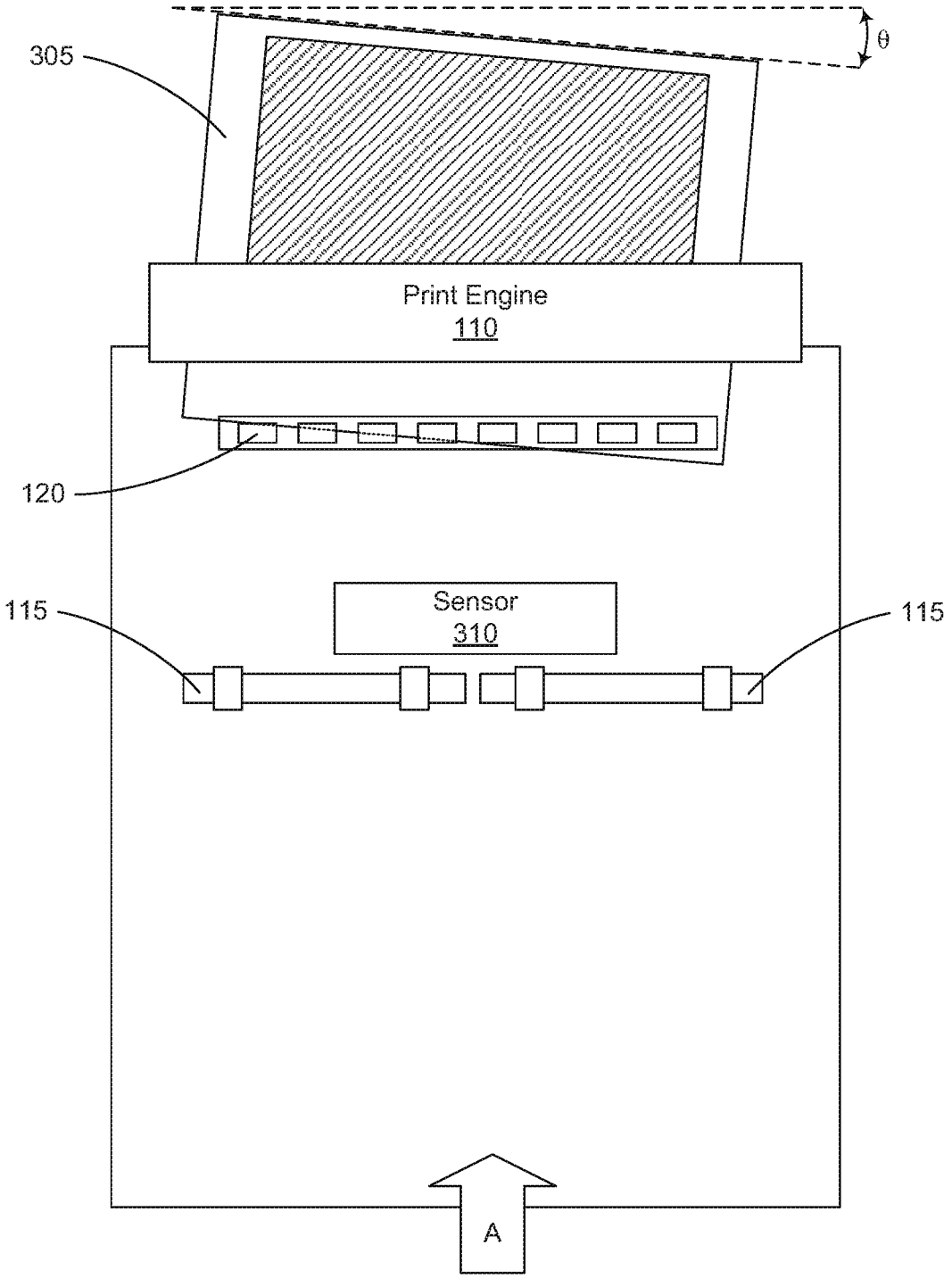
FIG. 5 is a block diagram showing a media feed path within a printing device according to an example of the principles described herein.

FIG. 5 is a block diagram showing a media feed path within a printing device (105) with the sheet of print medium (305) passing under a deskewed print engine (110). In one example, the print engine (110) is deskewed and is maintained perpendicular to the media feed path. In this example, the print engine (110) prints onto the sheet of print medium (305) by compensating for the skewness of the sheet of print medium (305) skewed at angle θ. To accomplish this, the print engine (110) receives instructions from a print controller, a processor, and/or a rasterizer compensating for the skewness of the sheet of print medium (305). The compensation accounts for the top-of-form and edge registration properties of the digital representation of the image to be printed. Consequently, while printing the image onto the sheet of print medium (305), the print engine (110) may begin printing a top corner of the image instead of an entire length of the edge of the sheet of print medium (305). Printing the image onto the sheet of print medium (305) may continue while the pinch rollers (120) continue to transport the sheet of print medium (305) through the media feed path and under the print engine (110).

In another example, the print engine (110) may receive instructions from a print controller, a processor, and/or a rasterizer to not compensate for the skewness of the sheet of print medium (305). In this example, the angle θ may be small enough that a slight misalignment between the edges of the sheet of print medium and the image being printed thereon may be unnoticeable to a user. In this example, the printing device may automatically determine whether the skewness of the sheet of print medium necessitates deskewness compensation by the print controller, a processor, and/or a rasterizer. Other factors may be taken into consideration when the printing device (105) determines whether to compensate for the skewness of the sheet of print medium (305) or not. These consideration may include the size of the sheet of print medium, the type of materials the sheet of print medium is made out of, and/or the weight of the sheet of print medium.

As described above, the printing device (105) may include a user selectable option to selectively disable the skewing of the sheet of print medium (305). When the skewing of the sheet of print medium (305) is suspended due to a user's selection of this option, the print controller, a processor, and/or a rasterizer may suspend compensating for any media skew and continue with printing on the sheet of print medium (305) without skewing the digital representation of the image.

In one example, the printing device (105) may include a user selectable option to selectively disable the skewing of the sheet of print medium (305) when specific types of medium are detected. In one example, the printing device (105) may detect the type of media being used by, for example, a sensor. The type of media used may vary in size, weight and materials. In one example, the printing device (105) may so indicate that skewing the sheet of medium may be beneficial or not beneficial during the printing process. The user may then so indicate as to whether the print job is to be conducted while the print medium is skewed or not.

In another example, the printing device (105) may be instructed to print from, for example, a specific drawer of medium containing a known type of medium. In this example, the printing device (105) may know the type of medium being printed on and act accordingly. In one example, the printing device (105), when it has detected a certain type of medium, consult a look-up table to determine whether that type of medium being used should be skewed prior to impingement with the pinch rollers (120). Each type, size, and color of medium may have an associated value associated with it telling the printing device (105) whether to skew the sheet of print medium (305) being used or not. In one example, a threshold skewness angle θ may be set to prevent the printing device (105) from skewing any sheet of medium retrieved from a drawer of medium. This may be because the media feed path may be too short to receive an aligned sheet of medium and skew it before it is received at the pinch rollers (120). In this case, the option to skew the print medium may not be provided to a user of the printing device (105) or alternatively, the user may be instructed to add the sheet of medium manually to the media feed path.

Figure 6:
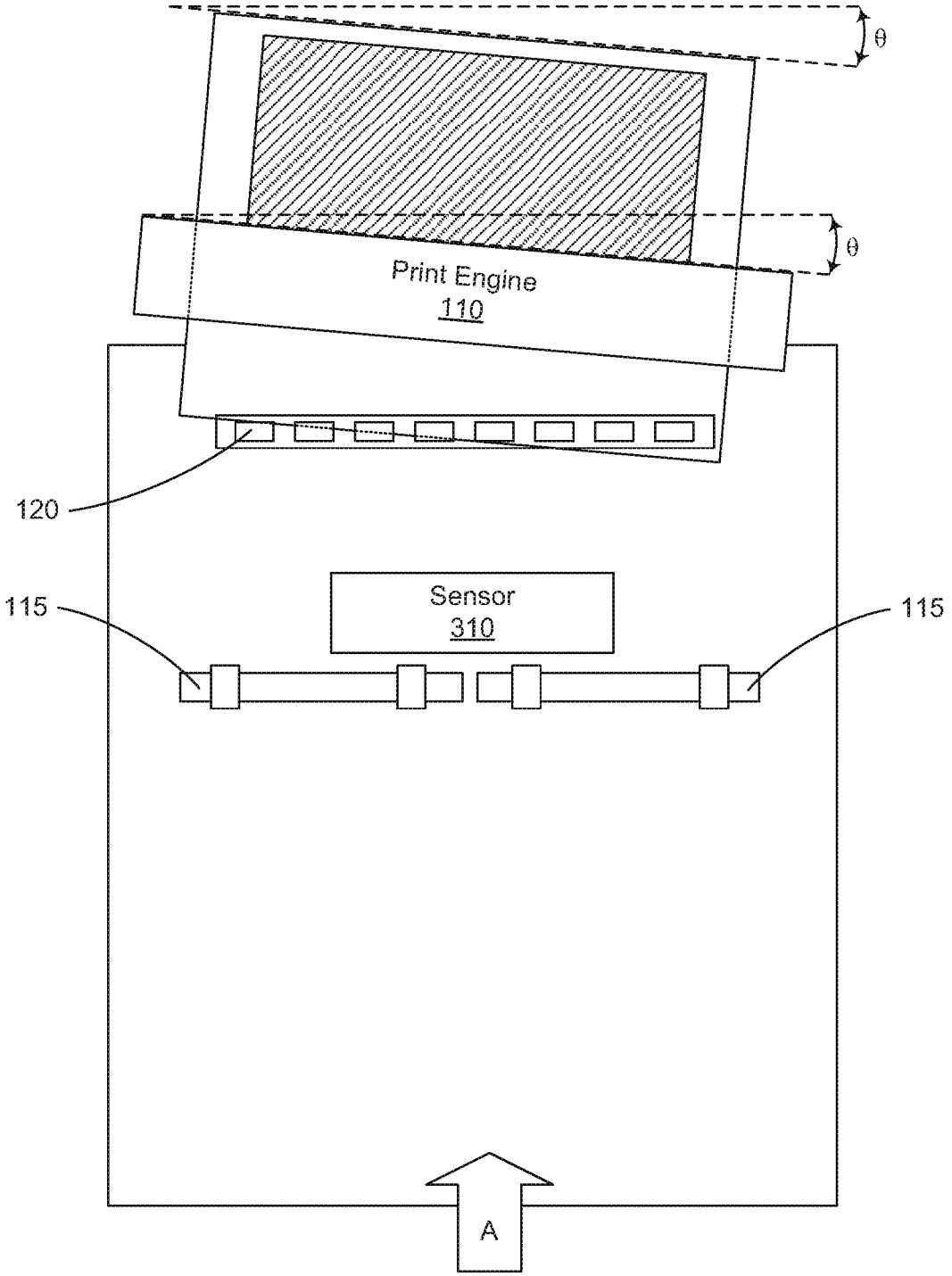
FIG. 6 is a block diagram showing a media feed path within a printing device according to an example of the principles described herein.

FIG. 6 is a block diagram showing a media feed path within a printing device (105) according to an example of the principles described herein. Similar to the printing device (105) and media feed path shown in FIG. 5, the printing device (105) includes a number of media skewing rollers (115), a number of pinch rollers (120), a skewness sensor (310), and a print engine (110). Unlike, FIG. 5, however, the print engine (110) in FIG. 6 is capable of being skewed relative to the media feed path and pinch rollers (120). In particular, the print engine (110) may be skewed by the same angle θ by which the sheet of print medium (305) has been skewed. Skewing the print engine (110) to the angle θ allows the pinch rollers (120) to transport the sheet of print medium (305) along the media feed path without the printing device (105) having to compensate for the skewness of the sheet of print medium (305). In particular, the print controller, processor, and/or rasterizer may not need to compensate for the skewness of the sheet of print medium (305) by altering the properties of the digital representation of the image to be printed. In one example, the print engine (110) may be manually skewed by a user of the printing device (105) to match the skewness angle θ of the sheet of print medium (305). This may be done before any printing occurs by setting a specific angle θ of skewness of the sheet of print medium (305) and adjusting the print engine (110) to match that angle. In one example, the printing device (105) may automatically adjust the print engine (110) after determining the angle θ skewness of the sheet of print medium (305) as indicated by the skewness sensor (310). In this example, if the skewness of the sheet of print medium (305) changes after being transported through the pinch rollers (120), the skewness sensor (310) may detect this change and accordingly change the skewness of the print engine (110). Various mechanical and electrical devices may be used to alter the skewness of the print engine (110) including rails, quick releases, and electrical engines.

The skewed print engine (110) may receive the skewed sheet of print medium (305) at an angle θ as indicated in FIG. 6. During printing, the top-of-form and edge registration properties of the digital representation of the image to be printed may also be maintained thereby presenting the finished printed sheet of print medium (305) visually appealing and error free.

The examples described in connection with FIGS. 1-6 may be used to print any number of images onto the sheet of print medium. In one example, the print controller, a processor, and/or a rasterizer used for compensating for the skewness of the sheet of print medium may determine whether to skew the sheet of print medium based on the content of the image to be printed. In this example, the print controller, a processor, and/or a rasterizer may determine that images such as lines or boxes may not be printed appropriately when the sheet of print medium is skewed. As a result, the printing device (105) via the print controller, a processor, and/or a rasterizer may not skew the sheet of print medium during printing. In another example, the image to be printed may be a picture. Because there are no line or boxes to be printed in the image, the print controller, a processor, and/or a rasterizer may indicated that the image can be printed onto skewed sheets of print medium and provide that option to the user.

Figure 7:
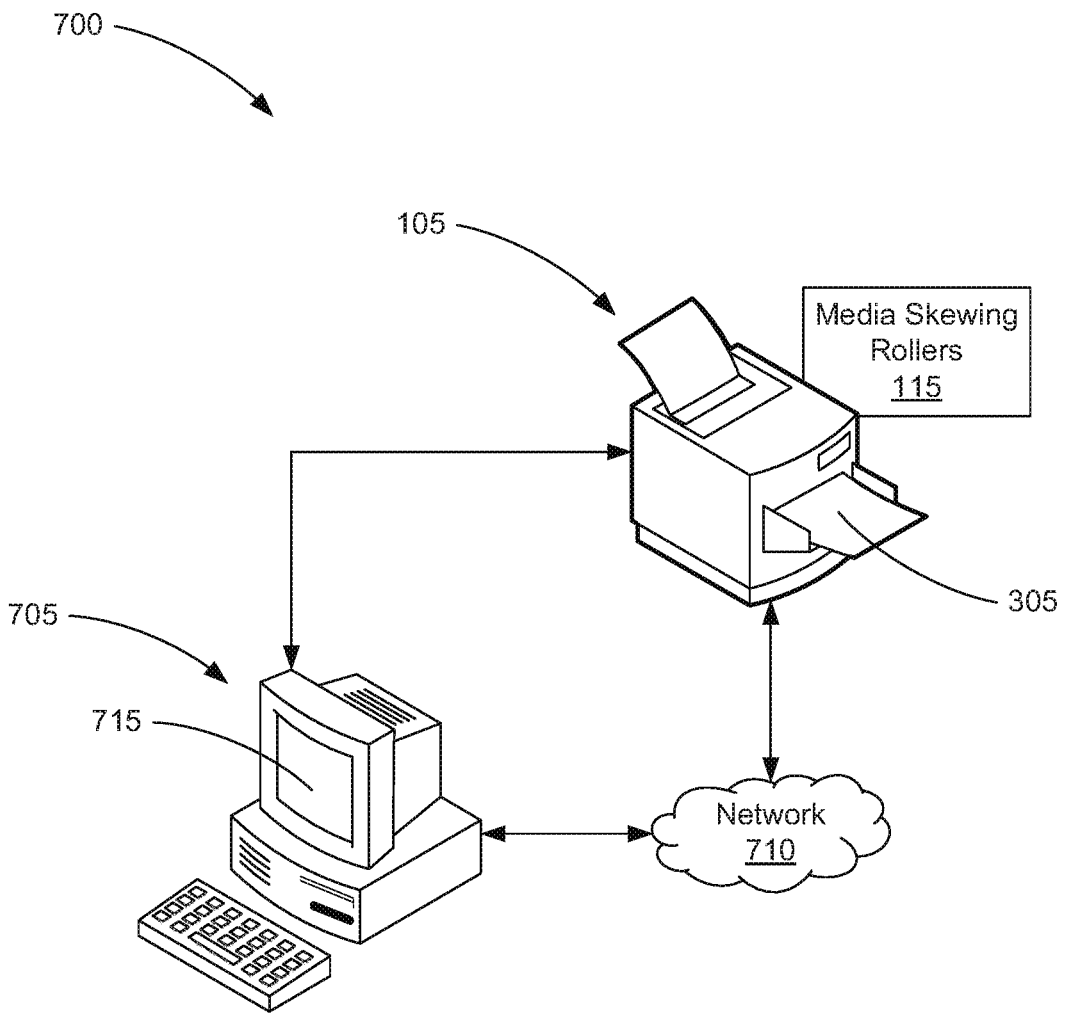
FIG. 7 is a block diagram of a printing system including a printing device that skews media along a media feed path according to an example of the principles described herein.

FIG. 7 is a block diagram of a printing system (700) including a printing device (105) that skews media along a media feed path according to an example of the principles described herein. The system (700) may include a computing device (705) coupled to the printing device (105) either directly using, for example, a USB connection, or indirectly through a network (710).

Examples of a computing device include servers, desktop computers, laptop computers, personal digital assistants (PDAs), mobile devices, smartphones, gaming systems, and tablets, among other electronic devices. The computing device (705) may include a processor such as a print controller and/or a rasterizer to provide digital print data to the print engine (110) described in FIGS. 1-6. The processor may include the hardware architecture to retrieve executable code from the data storage device and execute the executable code. The executable code may, when executed by the processor, cause the processor to implement at least the functionality of providing digital printing data to the print engine, according to the methods of the present specification described herein. In the course of executing code, the processor may receive input from and provide output to a number of the remaining hardware units.

The data storage device may store data such as executable program code that is executed by the processor or other processing device. The data storage device may specifically store computer code representing a number of applications that the processor executes to implement at least the functionality described herein.

The data storage device may include various types of memory modules, including volatile and nonvolatile memory. For example, the data storage device of the present example includes Random Access Memory (RAM), Read Only Memory (ROM), and Hard Disk Drive (HDD) memory. Many other types of memory may also be utilized, and the present specification contemplates the use of many various type(s) of memory in the data storage device as may suit a particular application of the principles described herein. In certain examples, different types of memory in the data storage device may be used for different data storage needs. For example, in certain examples the processor may boot from Read Only Memory (ROM), maintain nonvolatile storage in the Hard Disk Drive (HDD) memory, and execute program code stored in Random Access Memory (RAM).

Generally, the data storage device may include a computer readable medium, a computer readable storage medium, or a non-transitory computer readable medium, among others. For example, the data storage device may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The computing device may further include a number of hardware adapters that enable the processor to interface with various other hardware elements, external and internal to the computing device (705). For example, the peripheral device adapters may provide an interface to input/output devices, such as, for example, a display device (715), a mouse, or a keyboard. The peripheral device adapters may also provide access to other external devices such as an external storage device, a number of network devices such as, for example, servers, switches, and routers, client devices, other types of computing devices, and combinations thereof.

The display device (715) may be provided to allow a user of the computing device (705) to interact with and implement the functionality of the computing device (705). The peripheral device adapters may also create an interface between the processor and the display device (715), the printing device (105), or other media output devices. A network adapter may be provided and may interface to other computing devices within, for example, a network (710), thereby enabling the transmission of data between the computing device (705) and other devices located within or coupled to the network (710).

The computing device (705) may, when executing the processor, display a number of graphical user interfaces (GUIs) on the display device (715) associated with the executable program code representing the number of applications stored on the data storage device. The GUIs may include aspects of the executable code including providing a user of the computing device (705) print options associated with the printing device (105) including skewing the sheet of print medium (305). The GUIs may display, for example, an option to turn on or turn off the ability of the printing device (105) to skew a sheet of print medium (305) while printing. Additionally, via making a number of interactive gestures on the GUIs of the display device (715), a user may direct the printing device (105) to print an image onto a sheet of print medium (305) while the sheet of print medium (305) is skewed or not skewed. Examples of display devices (715) include a computer screen, a laptop screen, a mobile device screen, a personal digital assistant (PDA) screen, and a tablet screen, among other display devices (715).

Figure 8:
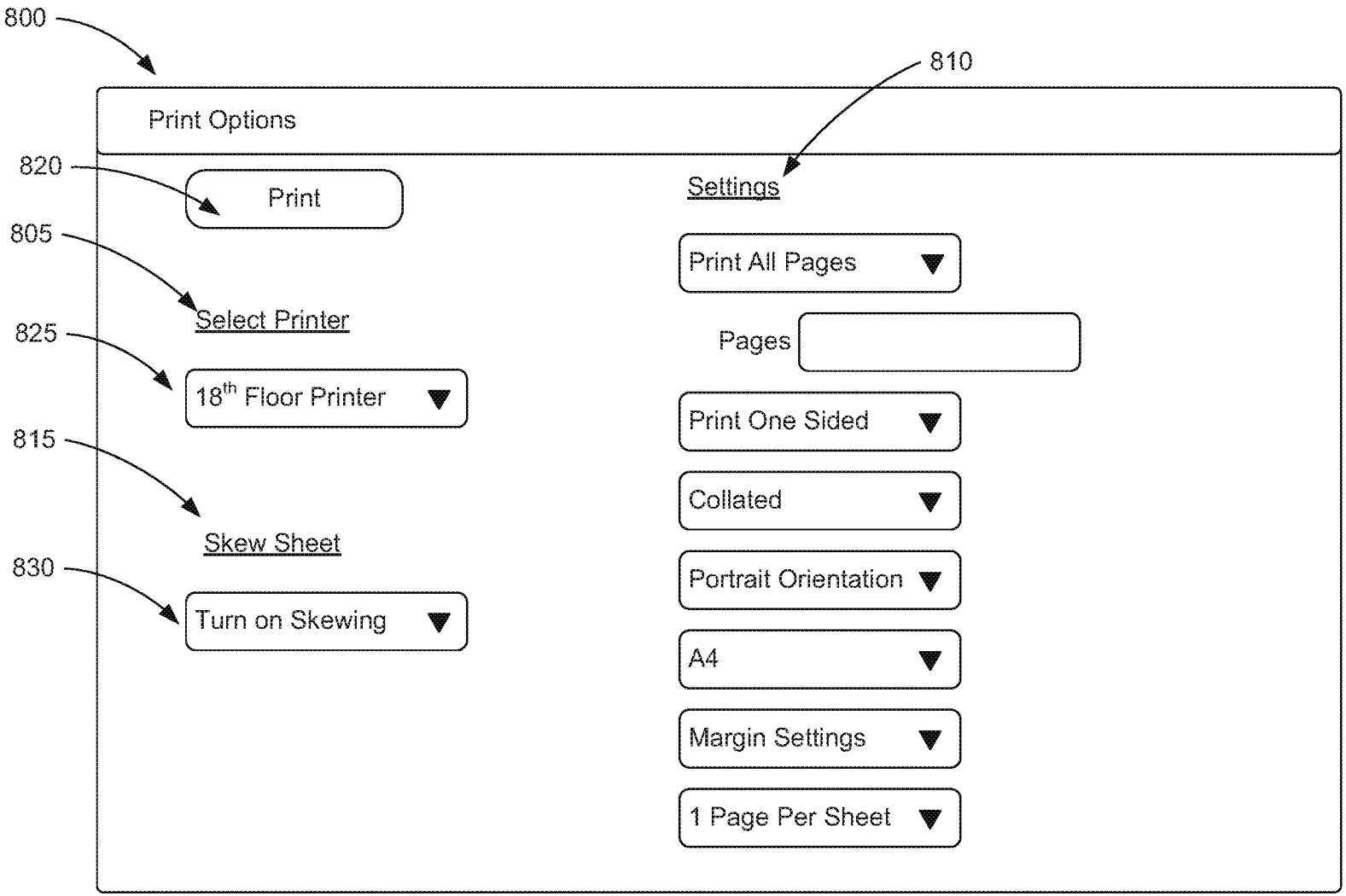
FIG. 8 is a block diagram of a graphical user interface (GUI) displayed on a display device of a computing device coupled to the printing device according to one example of the principles described herein.

FIG. 8 is a block diagram of a GUI (800) displayed on the display device (715) according to one example of the principles described herein. The GUI (800) may include a print button (820) for selection by a user in order to initiate a printing process. The GUI (800) may further include a number of categories and preferences to change before requesting, via the display device (715) of the computing device (705), to print an image on a sheet of print medium (305). The preferences may be divided into a select printer category (805), a skew sheet category (815), and a settings category (810).

The select printer category (805) may include a printer drop down box (825) used to select from among a number of printing devices (105) communicatively coupled to the computing device (705). Any number of printing devices may be listed including the printing device (105) including the media skewing rollers (115), pinch rollers (120), and print engine (110) as described above. Upon selection of the printing device (105), a second category may be accessible to the user: the skew sheet category (815), for example. The skew sheet category (815) may include a skew sheet drop down box (830) including at least two options: turn on skewing or turn off skewing. These options allow a user to selectively enable or disable the skewing abilities of the printing device (105) as described above.

The GUI (800) may further include a settings category (810) including a number of settings that alter the type of print medium to be printed on as well as how a digital image is to be represented on the print medium. These features may all be affected by a user's selection of whether the sheet of print medium (305) is to be skewed during printing or not.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, a processor of the computing device (705) or other programmable data processing apparatus, implement the functions or acts specified in a block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe skewing a print medium. The skewing of the print medium may reduce any transition-related print quality errors. The printing device (105) may not present any tradeoffs associated with, for example, a modified pinch roller system as described above. Additionally, the printing device (105) described herein with the media skewing rollers (115) may be switched on and off so as to selectively skew a sheet of print medium (305) based on user input, type of media used, and/or other considerations.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing device comprising:

a skew sensor to determine a first angle of a print medium with respect to a media feed path;

a number of media skewing rollers to increase skew of the print medium so that the skewed print medium has a skew angle of a predetermined angle greater than the first angle with respect to the media feed path, wherein operation of the number of media skewing rollers is based on the determination of the first angle by the skew sensor; and a print engine to print an image on the skewed print medium, the print engine skewing a digital representation of the image based on the predetermined angle such that the image printed is aligned with the print medium.

2. The printing device of claim 1, wherein the number of media skewing rollers are driven independent of each other and the number of media skewing rollers cooperate to create the skew angle.

3. The printing device of claim 1, wherein the print engine maintains a top-of-form and edge registration properties of the digital representation of the image when aligning the printed image with the print medium.

4. The printing device of claim 1, wherein the predetermined angle is less than 10 degrees.

5. The printing device of claim 1, further comprising a number of deskewing rollers to deskew the print medium with respect to the media feed path prior to the skewing rollers skewing the print medium.

6. The printed device of claim 1, further comprising a number of pinch rollers to receive the skewed print medium prior to the print medium receiving an image.

7. The printing device of claim 1, wherein the sensor provides closed loop feedback to the number of media skewing rollers to continually maintain the skew angle at the predetermined angle.

8. The printed device of claim 1, wherein the skew sensor is to move with the print medium along a portion of the media feed path.

9. A printing device, comprising:

a skew sensor to determine a first angle of a print medium with respect to a media feed path;

a number of skewing rollers to further skew in the print medium with respect to the media feed path so as to create a skew angle at a predetermined angle, wherein operation of the number of skewing rollers is based on the determination of the first angle by the skew sensor;

a number of pinch rollers to receive the skewed print medium prior to printing; and a print engine to be skewed to the skew angle of the print medium.

10. The printing device of claim 9, wherein the predetermined angle is 0.25 to 10 degrees.

11. The printing device of claim 9, wherein the skew sensor is to move with the print medium along a portion of the media path.

12. The printing device of claim 9, wherein the skew sensor provides continuous feedback to direct the number of skewing rollers to maintain the skew angle of the print medium at the predetermined angle as the print medium progresses along the media path.

13. The printing device of claim 9, wherein the print engine maintains top-of-form and edge registration properties associated with an image to be printed by the print engine.

14. A non-transitory computer-readable storage medium encoded with instructions executable by a processor, the computer-readable storage medium comprising instructions to:

(a) receive information from a sensor, the information being indicative of a first angle of a print medium in a media feed path;

(b) operate a number of skew rollers, based on the information from the sensor, to create a skew angle of the print medium, the skew angle being greater than the first angle such that skew of the print medium is increased by the skew rollers to a predetermined angle.

15. The non-transitory computer-readable storage medium of claim 14, further comprising instructions to:

repeat (a) and (b) continuously as the print medium progresses through at least a part of the media feed path.

16. The non-transitory computer-readable storage medium of claim 14, further comprising instructions to:

cause a print engine to be skewed to the skew angle of the print medium.

17. The non-transitory computer-readable storage medium of claim 14, wherein the instructions to operate a number of skew rollers includes instructions to drive each skew roller of the number of skew rollers independently of the other skew rollers.

* * * * *